US008011996B2

(12) United States Patent
Kuebler

(10) Patent No.: US 8,011,996 B2
(45) Date of Patent: Sep. 6, 2011

(54) POLISHING HEAD FOR A POLISHING MACHINE

(75) Inventor: Christoph Kuebler, Oberkochen (DE)

(73) Assignee: Carl Zeiss Vision GmbH, Aalen (DE)

( * ) Notice: Subject to any disclaimer, the term of this patent is extended or adjusted under 35 U.S.C. 154(b) by 0 days.

(21) Appl. No.: 11/837,918

(22) Filed: Aug. 13, 2007

(65) Prior Publication Data

US 2008/0020691 A1 Jan. 24, 2008

Related U.S. Application Data

(60) Division of application No. 10/949,505, filed on Sep. 24, 2004, now Pat. No. 7,588,480, which is a continuation of application No. 10/211,750, filed on Aug. 2, 2002, now abandoned, which is a continuation-in-part of application No. PCT/EP01/00253, filed on Jan. 11, 2001.

(30) Foreign Application Priority Data

Feb. 3, 2000 (DE) ..... 100 04 455

(51) Int. Cl.
*B24B 13/00* (2006.01)

(52) U.S. Cl. ..... 451/158; 451/277; 451/288

(58) Field of Classification Search ..... 451/158, 451/159, 277, 283–290
See application file for complete search history.

(56) References Cited

U.S. PATENT DOCUMENTS 2,821,813 A 2/1958 Degler
2,836,939 A 6/1958 White
2,916,857 A * 12/1959 Dargie ..... 451/277
2,994,164 A * 8/1961 Dalton ..... 451/42
3,226,887 A 1/1966 Rudd et al.
3,330,075 A 7/1967 Sudarth et al.
3,589,078 A 6/1971 Bala et al.
3,624,969 A 12/1971 Dalton
3,874,123 A 4/1975 Hopkins et al.
3,877,177 A * 4/1975 Taniguchi ..... 451/159
3,886,696 A 6/1975 Brück
3,897,703 A * 8/1975 Phipps ..... 81/177.75
3,900,971 A 8/1975 Brueck (Continued)

FOREIGN PATENT DOCUMENTS

CH 556719 12/1974

(Continued)

OTHER PUBLICATIONS

H. Goersch, "Dictionary for Optometry," 2nd ed., Bode Pforzheim Publishers 2001. (English translation included).

(Continued)

*Primary Examiner* — Maurina Rachuba
(74) *Attorney, Agent, or Firm* — Fish & Richardson P.C.

(57) ABSTRACT

A polishing head for polishing machines, in particular for polishing optical surfaces, has a polishing plate that is connected to a rotationally drivable drive shaft. The polishing plate is articulated to, and rotates with, the drive shaft. A ball hexagonal socket joint provides the articulated connection. Rotating by means of the articulated connection, the polishing plate can follow the surface of the workpiece to be processed, so that the polishing covering on the polishing plate always rests on a maximally large area on the surface of the workpiece.

31 Claims, 2 Drawing Sheets

U.S. PATENT DOCUMENTS

| | | | | | |
|---|---|---|---|---|---|
| 3,968,598 | A | | 7/1976 | Ogawa | |
| 4,068,413 | A | | 1/1978 | Suddarth | |
| 4,128,968 | A | | 12/1978 | Jones | |
| 4,135,890 | A | | 1/1979 | Billault | |
| 4,166,342 | A | | 9/1979 | Shaffer et al. | |
| 4,173,848 | A | * | 11/1979 | Ikeno | 451/159 |
| 4,201,018 | A | | 5/1980 | Pool | |
| 4,232,485 | A | | 11/1980 | Eadon-Allen | |
| 4,392,331 | A | | 7/1983 | Schimitzek et al. | |
| 4,829,716 | A | * | 5/1989 | Ueda et al. | 451/292 |
| 4,956,944 | A | * | 9/1990 | Ando et al. | 451/5 |
| 4,974,368 | A | | 12/1990 | Miyamoto et al. | |
| 4,999,954 | A | | 3/1991 | Miyamoto et al. | |
| 5,069,081 | A | | 12/1991 | Morita | |
| 5,138,798 | A | | 8/1992 | Volat | |
| 5,154,020 | A | | 10/1992 | Kajima | |
| 5,347,763 | A | | 9/1994 | Miyamato et al. | |
| 5,421,770 | A | * | 6/1995 | Bobst | 451/390 |
| 5,577,950 | A | | 11/1996 | Smith et al. | |
| 5,695,393 | A | | 12/1997 | Granziera | |
| 5,759,457 | A | | 6/1998 | Inoue et al. | |
| 5,761,985 | A | * | 6/1998 | Stoll | 92/165 PR |
| 5,957,756 | A | | 9/1999 | Figge et al. | |
| 6,082,987 | A | | 7/2000 | Su et al. | |
| 6,089,713 | A | | 7/2000 | Hof et al. | |
| 6,165,057 | A | | 12/2000 | Gill | |
| 6,276,994 | B1 | | 8/2001 | Yoshida et al. | |
| 6,796,877 | B1 | | 9/2004 | Bingham et al. | |
| 2003/0045211 | A1 | | 3/2003 | Kuebler | |

FOREIGN PATENT DOCUMENTS

| | | | | |
|---|---|---|---|---|
| CH | 556719 | A | * | 12/1974 |
| DE | 318561 | | | 1/1920 |
| DE | 1 239 211 | | | 4/1967 |
| DE | 2 252 503 | | | 5/1974 |
| DE | 27 42 307 | | | 3/1978 |
| DE | 41 01 132 | | | 7/1991 |
| DE | 689 03 661 | T2 | | 6/1993 |
| DE | 42 14 266 | | | 11/1993 |
| DE | 44 42 181 | | | 10/1995 |
| DE | 295 21 396 | | | 2/1997 |
| DE | 298 03 158 | | | 8/1998 |
| DE | 197 56 960 | | | 6/1999 |
| DE | 694 16 943 | T2 | | 8/1999 |
| DE | 101 64 628 | | | 9/2002 |
| EP | 0 567 894 | | | 11/1993 |
| EP | 0 727 280 | B1 | | 9/1997 |
| EP | 0 835 722 | A1 | | 4/1998 |
| EP | 0 655 297 | B1 | | 3/1999 |
| EP | 1 251 997 | | | 10/2002 |
| GB | 1 011 741 | | | 12/1965 |
| JP | 63-232948 | | | 9/1988 |
| JP | 4-201054 | | | 7/1992 |
| JP | 4-244372 | | | 9/1992 |
| JP | 5-88859 | | | 12/1993 |
| JP | 4-019058 | | | 1/1998 |
| JP | 10-545 | | | 1/1998 |
| JP | 10-29149 | | | 2/1998 |
| JP | 2002-346895 | A1 | | 12/2002 |
| JP | 2004025314 | A | * | 1/2004 |
| WO | WO 97/00155 | | | 1/1997 |
| WO | WO 97/00155 | A1 | | 1/1997 |
| WO | WO 00/32353 | | | 6/2000 |
| WO | WO 01/56740 | | | 8/2001 |

OTHER PUBLICATIONS

Documents filed in European Patent Application No. 01 909 601.5: Statement of Grounds of Appeal in EP, submitted Oct. 18, 2007; Change of representative of objecting party, submitted Sep. 26, 2007; Appeal of Interim Decision, submitted Aug. 14, 2007. (English translation included).

Transcript of the Oral Argument for European Patent Application No. 01 909 601.5 (Jun. 12, 2007) (English translation included).

Documents related to Appeal No. T1365/07-3207 in EP Application 1251997, dated Mar. 7, 2008. (English translation included).

European Search Report for European Application No. EP 03 02 5546, 2 pages (Dec. 3, 2003).

International Search Report for International Application No. PCT/EP01/00253, 4 pages (Jun. 22, 2001).

Office Action for German Application No. DE 101 00 860.0-14, 3 pages (Apr. 18, 2005) (English translation included).

Arguments in Support of Opposition for European Publication No. EP 1 251 997, 23 pages (Jan. 13, 2005) (English translation included).

Reply to the Arguments in Support of Opposition for European Publication No. EP 1 251 997, 33 pages (Nov. 2, 2005) (English translation included).

Supplement to the Arguments in Support of Opposition for European Publication No. EP 1 251 997, 11 pages (Jun. 19, 2006) (English translation included).

Reply to the Supplement to the Arguments in Support of Opposition for European Publication No. EP 1 251 997, 11 pages (Oct. 11, 2006) (English translation included).

Opinion of the Opposition Division for European Publication No. EP 1 251 997, 4 pages (Dec. 13, 2006) (English translation included).

Patent Proprietor's Written Statement for the Oral Hearing for European Publication No. EP 1 251 997, 20 pages (Mar. 7, 2007) (English translation included).

Opponent's Written Statement for the Oral Hearing for European Publication No. EP 1 251 997, 4 pages (Mar. 12, 2007) (English translation included).

Rascher et al., "IFHEM—Innovative Production Concept for High Tech Surfaces through the Use of MRF Technology," University of Applied Sciences Deggendorf, http://www.fhd.edu/transfer/archiv/forschungsbericht-2002/redmb.html, 1 page (retrieved from the Internet on Feb. 6, 2007) (English translation included).

Transcript of the Oral Argument for German Application No. 01 909 601.5 (Jun. 12, 2007) (English translation included).

"Optics and optical instrucments—Preparation of drawings for optical elements and systems;" Part 12: Aspheric Surfaces, International Standard; Reference No. ISO 10110-12 Edition: Aug. 15, 1997.

Piegl et al., "Monographs in Visual Communication," The Nurbs Book, 2nd Edition, Springer 1997.

European Patent Office, Application No. 03025546.7, Notice of Appeal dated Feb. 25, 2010.

Prof. Dr.-Ing. Rascher et al., "Editorial Office for Mechanical Engineering", FH Deggendorf Knowledge and Technology Transfer, Feb. 16, 2010, pp. 1-10 (German with English translation).

Excerpt of the Online-Encyclopedia Wikipedia concerning the keyword "Pinole".

International Preliminary Examination Report with Written Opinion for corresponding PCT Application No. PCT/EP01/00253, dated May 22, 2002.

Office Action for German Application No. DE 101 00 860.0-14, with English translation, dated May 5, 2010.

Office Action from the Japanese Patent Office for corresponding JP Application No. 2001-556620, with English translation, dated Oct. 5, 2010.

Optician, Free-Form Technology, pp. 30-34, dated Nov. 16, 2007.

Summons to the oral proceedings dated Apr. 28, 2009.

Decision of the Engineering Board of Appeals 3.2.07 of Sep. 15, 2009, in EP Application No. 01909601.5, dated Oct. 20, 2009 (25 pages).

Certified English translation of Decision (26 pages), Oct. 20, 2009.

* cited by examiner

POLISHING HEAD FOR A POLISHING MACHINE

CROSS-REFERENCE TO RELATED APPLICATIONS

This application is a divisional application of and claims priority to U.S. application Ser. No. 10/949,505, filed Sep. 24, 2004, which is a continuation of and claims priority to U.S. application Ser. No. 10/211,750, filed on Aug. 2, 2002, which is a continuation-in-part of and claims priority to International Application No. PCT/EP01/00253, which claims priority to German Application Serial No. 100 04 455.7, filed Feb. 3, 2000.

STATEMENT REGARDING FEDERALLY SPONSORED RESEARCH OR DEVELOPMENT

Not applicable.

BACKGROUND OF THE INVENTION

The invention relates to a polishing head for a polishing machine, and more particularly, for polishing optical surfaces.

A polishing machine for polishing spherical lens surfaces is known from EP 727 280 B1. This polishing machine has an upper slide, which can move in an x-direction. A tool spindle, which is mounted for rotation around a vertical axis, is connected to this slide. The tool spindle serves to receive a surfacing tool. A workpiece spindle, connected to a further slide, is provided for receiving the respective workpiece or lens. The workpiece spindle, and the tool spindle with the surfacing tool, are arranged at a fixed distance from one another. The slide carrying these two spindles can move in the z-direction.

A polishing machine and a process for polishing optical surfaces are known from WO 97/00155. The polishing machine has a polishing head, which is provided with an elastic diaphragm. The application of force to the surface to be polished is regulated by the application of pressure to the diaphragm. In this polishing machine, it is a disadvantage that the size of the surface of the respective polishing head or diaphragm abutting the surface to be polished depends on the application of pressure. The polishing head, with the elastic diaphragm, is prestressed toward the surface to be polished by an associated spring. Hydraulic cylinders are provided in order to provide a tilting motion of the elastic diaphragm around a point situated on the rotation axis in the region of the flexible diaphragm. The application of force to the surface to be polished is detected by associated sensors, strain gages and solenoids.

In the process known from this publication, the polishing of the optical surface is controlled in dependence on the rotational speed of the polishing head, and the pressing force acting on the surface to be polished is controlled by means of the application of pressure.

SUMMARY OF THE INVENTION

The invention has as its object to provide a polishing head for polishing a free-form surface, by means of which a qualitatively high-value optical surface can be polished, and by the use of which a constant polishing removal over the whole optical surface to be polished can be ensured.

The object of the invention is attained by a polishing head, in particular for polishing optical surfaces, comprising a polishing plate having an articulated connection to a rotationally drivable drive shaft, wherein the polishing plate is connected to rotate with the drive shaft and articulated for the execution of tilting motions.

By means of the feature that the polishing plate is connected, articulated to rotate with the drive shaft, it is possible for the polishing plate to rest on the surface to be processed, following the surface contour. Due to the articulated connection, the polishing plate can execute tilting motions, so that it rests on a maximum polishing surface on the surface to be polished.

For the transmission of the rotational motion of the drive shaft to the polishing plate, the polishing plate is connected to the drive shaft by positive locking, so that the rotational motion of the drive shaft is transmitted to the polishing plate due to the positive locking.

The articulated, commonly rotating connection is connected to the polishing plate to rotate with the drive shaft by means of a ball hexagonal socket joint. It is possible by means of this ball hexagonal socket joint to arrange the pivot point, around which the polishing plate can be pivoted in optional directions, as close as possible to the polishing surface of the polishing plate. The arrangement of the articulated connection close to the polishing surface of the polishing plate has the advantage that the polishing plate can react quickly in following the surface contours.

One or more latch elements are assigned to the articulated connection, for securing the connection between the drive shaft and the polishing head. If a ball hexagonal socket joint is provided as the articulated connection, it is ensured by means of the latch element that the ball head cannot slip out of the associated recess. There are then no problems in removing the polishing plate from the surface to be polished. Furthermore, different polishing heads can easily be exchanged, due to the releasability of the connection ensured by the latch element.

A pressure chamber is arranged for the polishing head, so that a translational motion of the polishing plate along a mid-axis of the polishing head results from pressurizing the pressure chamber.

A piston allocated to the pressure chamber is effectively connected to the drive shaft, so that the application of pressure to the pressure chamber is transmitted via the drive shaft to the polishing plate.

The drive shaft drives by means of a coaxially arranged hollow cylinder with which the drive shaft is mounted to rotate. A positive connection transmits the rotary motion.

The drive shaft is mounted in the hollow cylinder by means of mounting elements, e.g., a roller bearing or a ball bearing. By this mounting the drive shaft can have a smooth-running translational motion, and accordingly the initiated translational motion is nearly completely transmitted to the polishing plate.

BRIEF DESCRIPTION OF THE DRAWINGS

The invention is described in detail hereinbelow with reference to an embodiment example.

DETAILED DESCRIPTION OF THE INVENTION

Figure 1:
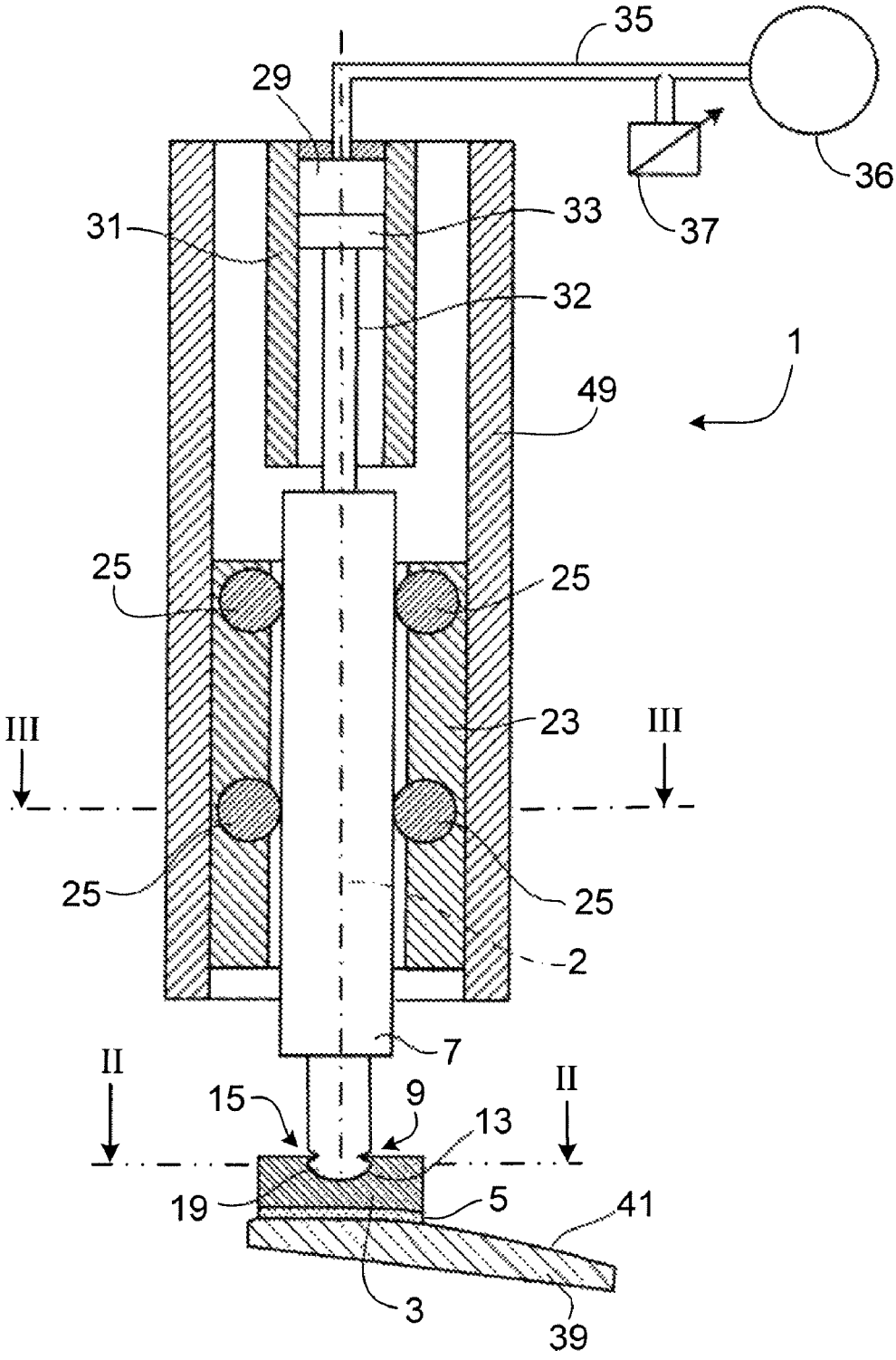
FIG. 1 shows a schematic sketch of the polishing head in a section containing its mid-axis.
Figure 2:
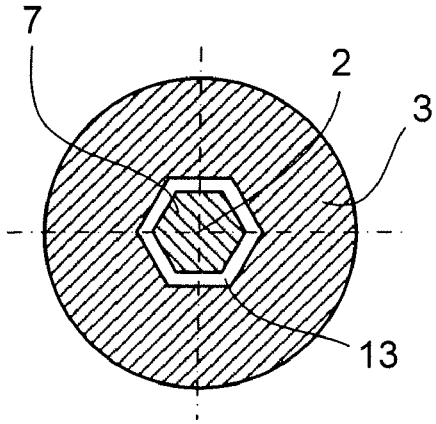
FIG. 2 shows a section along the plane II-II in FIG. 1.
Figure 3:
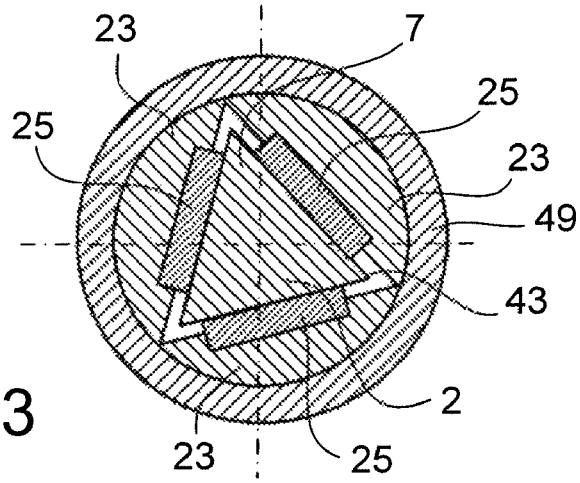
FIG. 3 shows a section along the plane III-III in FIG. 1.

The polishing head (1) shown in FIG. 1 has a polishing plate (3) with a polishing covering (5). The polishing covering (5) rests on a surface (41) of a workpiece (39) to be polished.

The polishing plate (3) is received on a drive shaft (7) via the articulated connection. In this embodiment example shown, a ball hexagonal socket joint is provided for this commonly rotatable articulated connection. For this purpose, the drive shaft (7) is provided at the end, on the side facing toward the polishing plate, with a ball head (19) that engages in a recess (13) formed in the polishing plate (3).

For securement, the connection between the ball head (19) and the polishing plate (3) is secured by means of a latch element (15). A spring element or spring pin on the polishing plate, projecting into a recess on the ball head, can for example be provided as the latch element.

It is also possible to constitute the ball head on the polishing plate (19); in this case, a recess is then provided in the drive shaft (7) for rotationally secure, articulated reception of the ball head. In this case, the distance between the joint place—i.e., the point around which a tilting of the polishing plate relative to the rigid drive shaft can take place—and the surface (41) to be polished is of course greater.

The drive shaft (7) can be displaced translationally by means of the mounting element (23) and is mounted in, and to rotate with, a hollow cylinder (49). The hollow cylinder (49) is driven rotationally by means of a drive (not shown) of the polishing machine, the rotational motion being fully transmitted to the drive shaft (7) for the polishing head due to the rotationally secured connection by means of the mounting element (23).

A hydraulic or pneumatic system, which serves to act on the polishing head with the required polishing pressure, is provided in the hollow cylinder (49) on the side of the drive shaft (7) remote from the polishing head. This system has a pressure chamber cylinder (31) with a translationally displaceable piston (33) received therein. To decouple the piston (33) from the rotary motion of the drive shaft (7) and of the hollow cylinder, swivel bearings can be provided between the pressure chamber cylinder (31) and the hollow cylinder (49) and also between the connecting rod (32) driven by the piston (33) and the drive shaft (7). A pressure supply (35) with a pressure control valve (37) and a pressure reservoir (36) is arranged for the pressure chamber (29) formed in the pressure chamber cylinder (31), to apply pressure to the piston (33). A force on the piston (33), directed along a mid-axis (2) of the polishing head (1), is initiated by applying pressure to the pressure chamber (29). There results from this force a respective translational motion of the polishing plate or increase of the effective polishing pressure, provided that the polishing covering (5) rests on an optical surface (41) of a workpiece (39) to be polished.

The translationally movable coupling for the hollow cylinder (49) to rotate with the drive shaft (7) takes place by means of a roller bearing element (23). The drive shaft (7) has for this purpose an external profile (43) that is noncircular, preferably a polygonal profile. The positive connection between the external profile (43) of the drive shaft (7) and the inner wall of the hollow cylinder is attained by means of rollers or cylinders (25) which are received in the bearing element (23) symmetrically of the external profile of the drive shaft (7) and which roll on the external profile of the drive shaft. The rotation axes of the rollers or cylinders are then directed perpendicular to the rotation axis of the drive shaft (7).

Figure 4:
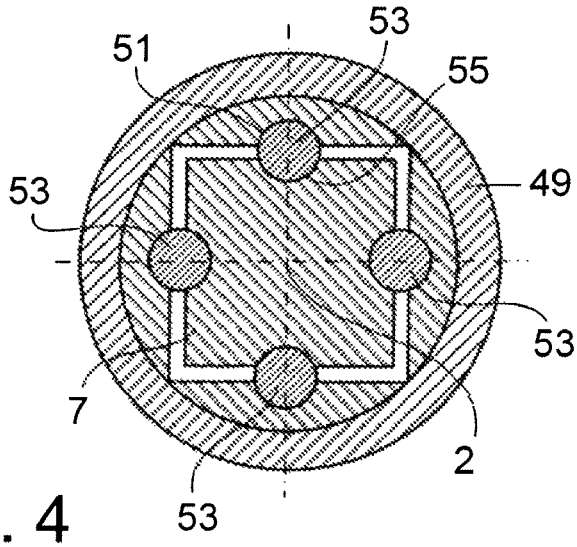
FIG. 4 shows a section along the plane III-III, in an alternative example.

Instead of the cylinder mounting of the drive shaft (7) in the hollow cylinder (49), a ball mounting can also be provided, as shown in FIG. 4. For a translationally displaceable connection, rotatable in common, the balls (53) are mounted in longitudinal grooves (51) of the hollow cylinder (49) and further longitudinal grooves (55) of the drive shaft (7), with the longitudinal grooves extending parallel to the rotation axis of the drive shaft (7). In this case also, the drive shaft has a non-rotationally-symmetrical external profile, in particular a polygonal profile, at least in a region corresponding to the mounting.

The polishing process is described in detail hereinafter. For polishing, the polishing head, the diameter of which is smaller than the diameter of the surface to be polished, moves in a swiveling motion in the radial direction over the optical surface (41) to be polished. Both the workpiece (39) and the polishing plate are driven with nearly equal rotational speed in an identical direction. When the polishing plate moves over the optical surface (41) to be polished, it can be provided to vary the rotational speeds of the polishing plate or the rotational speed of the workpiece, in particular in dependence on the radial position of the polishing plate. This variation of rotational speed has a positive effect on a constant polishing removal.

The pressure fluctuations are kept very small by the choice of a very large reservoir volume (36) in comparison with the varying volume of the piston (31), so that the polishing plate rests with a constant force on the optical surface to be polished. The pressure-regulating valve also contributes to the equalization of pressure fluctuations.

By means of the arrangement described, in connection with a prior art polishing machine, in particular optical surfaces (41) which are noncircular can be polished, the polishing removal being constant over the whole optical surface. It is necessary for the uniform polishing removal that the polishing covering of the polishing plate (3) rests on the optical surface (41) to be polished over as large as possible a surface. This is in particular ensured in that, by means of the articulated connection of the polishing plate to rotate with the drive shaft (7), the polishing plate can be tilted about a point situated on the mid-axis (2) of the polishing head, and the alignment of the polishing plate can thereby follow the surface contour of the surface (41) to be polished.

LIST OF REFERENCE NUMERALS

1 polishing head
2 mid-axis
3 polishing plate
5 polishing covering (~covering)
7 drive shaft
9 articulated connection
15 recess in polishing plate
19 ball head
20 recess
23 mounting elements
25 cylinders or rollers
29 pressure chamber
31 pressure chamber cylinder
32 connecting rod
33 piston
35 pressure supply
36 reservoir
37 pressure regulating valve
39 workpiece
41 optical surface
43 external profile
49 hollow cylinder
51 longitudinal grooves
53 balls
55 longitudinal groove in drive shaft

I claim:

1. A polishing machine, comprising:

a polishing head comprising a rotationally drivable drive shaft at least partially disposed within a hollow cylinder;

a roller bearing element disposed between the drive shaft and the hollow cylinder, wherein the roller bearing element is configured to rotationally fix the hollow cylinder relative to the drive shaft and to allow the drive shaft to move axially with respect to the hollow cylinder;

a polishing plate having an articulated connection to the rotationally drivable drive shaft, a fluid pressure chamber; and a piston disposed within the fluid pressure chamber, wherein the polishing head and the fluid pressure chamber have a common longitudinal axis, the fluid pressure chamber and piston are arranged so that applying fluid pressure to the fluid pressure chamber moves the piston along the common longitudinal axis and causes translational motion of the polishing plate along the common longitudinal axis, the polishing plate has a substantially smaller diameter than a free-form optical surface to be polished by the polishing plate, and the polishing plate is connected to rotate with the rotationally drivable drive shaft and articulated for execution of tilting motions, and wherein the polishing machine is configured to rotate the polishing plate and the free-form optical surface in the same direction of rotation and to move the polishing head in a swiveling motion in a radial direction over the free-form optical surface during polishing of the free-form optical surface, and the polishing machine is configured to cause the polishing plate to apply a constant force to the free-form optical surface during polishing of the free-form optical surface.

2. The polishing machine according to claim 1, wherein a rotation of the rotationally drivable drive shaft is transmitted by positive locking to the polishing plate.

3. The polishing machine according to claim 2, wherein the positive locking for transmitting rotational motion of the rotationally drivable drive shaft to the polishing plate is produced in the articulated connection.

4. The polishing machine according to claim 3, wherein the articulated connection comprises a ball hexagonal socket joint.

5. The polishing machine according to claim 1, wherein the polishing plate is mounted on the rotationally drivable drive shaft, tiltably about a point situated on the common longitudinal axis.

6. The polishing machine according to claim 1, further comprising a latch element for securing the articulated connection of the polishing plate and the rotationally drivable drive shaft.

7. The polishing machine according claim 1, wherein the fluid pressure chamber comprises a fluid pressure chamber cylinder in which the piston is arranged to be movable translationally.

8. The polishing machine according to claim 7, wherein the piston is in operative connection with the rotationally drivable drive shaft.

9. The polishing machine according to claim 1, wherein the rotationally drivable drive shaft is mounted in the cylinder to be displaceable translationally along the common longitudinal axis for common rotation with the polishing head.

10. The polishing machine according to claim 1, wherein the rotationally drivable drive shaft is mounted, displaceable translationally and to rotate in common along the common longitudinal axis, and has a connection to rotate in common with a rotationally driven piston.

11. The polishing machine according to claim 1, wherein at least a portion of the rotationally drivable drive shaft has a non-rotationally-symmetrical external profile.

12. The polishing machine according to claim 11, wherein the external profile is in the form of a polygonal profile.

13. The polishing machine according to claim 11, wherein the rotationally drivable drive shaft is mounted in the hollow cylinder to be displaceable translationally along the common longitudinal axis, and the external profile is connected to rotate with the hollow cylinder.

14. The polishing machine according to claim 11, wherein the external profile has longitudinal grooves in which balls are arranged by which the rotationally drivable drive shaft is connected to the hollow cylinder which is provided on an inner side with opposed longitudinal grooves.

15. The polishing machine of claim 11, wherein the roller bearing element is disposed between the non-rotationally symmetrical external profile of the drive shaft and the hollow cylinder.

16. The polishing machine according to claim 1, further comprising a reservoir in fluid communication with the fluid pressure chamber, the reservoir having a first volume and the fluid pressure chamber having a second volume, the first volume being substantially greater than the second volume.

17. The polishing machine according to claim 1, further comprising a valve configured to regulate pressure within the fluid pressure chamber.

18. The polishing machine according to claim 17, further comprising a reservoir in fluid communication with the fluid pressure chamber, the valve being positioned between the reservoir and the fluid pressure chamber.

19. The polishing machine according to claim 18, wherein the reservoir has a first volume and the fluid pressure chamber has a second volume, the first volume being substantially greater than the second volume.

20. The polishing machine according to claim 1, wherein the pressure chamber is positioned above the drive shaft, and a rod is attached at a first end to the piston disposed within the pressure chamber and at a second end to the drive shaft.

21. The polishing machine of claim 1, wherein the polishing machine is configured to rotate the polishing plate relative to the free-form optical surface.

22. The polishing machine of claim 1, wherein the roller bearing element comprises a plurality of rollers configured to roll along an external profile of the drive shaft when the drive shaft is moved axially relative to the roller bearing element and the hollow cylinder.

23. The polishing machine of claim 22, wherein the drive shaft and the hollow cylinder define axial grooves, and the rollers are in the form of balls that are partially disposed within aligned axial grooves of the drive shaft and the hollow cylinder.

24. The polishing machine of claim 22, wherein the external profile of the drive shaft is polygonal, and the rollers are in the form of cylinders.

25. The polishing machine of claim 1, wherein the polishing plate has a diameter that is about one half the diameter of the free-form optical surface.

26. A polishing machine, comprising:

a polishing head comprising a rotationally drivable drive shaft at least partially disposed within a hollow cylinder;

a roller bearing element disposed between the drive shaft and the hollow cylinder, wherein the roller bearing element is configured to rotationally fix the hollow cylinder relative to the drive shaft and to allow the drive shaft to move axially with respect to the hollow cylinder;

a polishing plate having an articulated connection to the rotationally drivable drive shaft, a fluid pressure chamber; and a piston disposed within the fluid pressure chamber, wherein the fluid pressure chamber and piston are arranged so that applying fluid pressure to the fluid pressure chamber moves the piston and causes translational motion of the polishing plate, the polishing plate has a substantially smaller diameter than a free-form optical surface to be polished by the polishing plate, and the polishing plate is connected to rotate with the rotationally drivable drive shaft and articulated for execution of tilting motions, and wherein the polishing machine is configured to rotate the polishing plate and the free-form optical surface in the same direction of rotation and to move the polishing head in a swiveling motion in a radial direction over the free-form optical surface during polishing of the free-form optical surface, and the polishing machine is configured to cause the polishing plate to apply a constant force to the free-form optical surface during polishing of the free-form optical surface.

27. The polishing machine according to claim 26, wherein at least a portion of the rotationally drivable drive shaft has a non-rotationally-symmetrical external profile.

28. The polishing machine of claim 27, wherein the roller bearing element is disposed between the non-rotationally symmetrical external profile of the drive shaft and the hollow cylinder.

29. The polishing machine of claim 26, wherein the roller bearing element comprises a plurality of rollers configured to roll along an external profile of the drive shaft when the drive shaft is moved axially relative to the roller bearing element and the hollow cylinder.

30. The polishing machine of claim 26, wherein the polishing machine is configured to rotate the polishing plate relative to the free-form optical surface.

31. The polishing machine of claim 26, wherein the polishing plate has a diameter that is about one half the diameter of the free-form optical surface.

* * * * *

UNITED STATES PATENT AND TRADEMARK OFFICE

CERTIFICATE OF CORRECTION

PATENT NO. : 8,011,996 B2
APPLICATION NO. : 11/837918
DATED : September 6, 2011
INVENTOR(S) : Christoph Kuebler It is certified that error appears in the above-identified patent and that said Letters Patent is hereby corrected as shown below:

On the Title Page

Page 2, Item (56) (Other Publications)
Line 39, delete "instrucments" and insert --instruments--

Column 5,
Line 55, delete "according" and insert --according to--

Signed and Sealed this
Eighteenth Day of October, 2011

David J. Kappos

David J. Kappos
*Director of the United States Patent and Trademark Office*